US006607244B2

(12) United States Patent
Stulik et al.

(10) Patent No.: US 6,607,244 B2
(45) Date of Patent: Aug. 19, 2003

(54) RECLINING CHAIR

(76) Inventors: Edward L. Stulik, 7500 Hill Rd., Granite Bay, CA (US) 95746; Bruce Burness, 1260 Yocum St., Pasadena, CA (US) 91103

( * ) Notice: Subject to any disclaimer, the term of this patent is extended or adjusted under 35 U.S.C. 154(b) by 0 days.

(21) Appl. No.: 09/824,120

(22) Filed: Apr. 2, 2001

(65) Prior Publication Data

US 2002/0171278 A1 Nov. 21, 2002

(51) Int. Cl.[7] ..... A47C 7/60
(52) U.S. Cl. ..... 297/302.4; 297/303.4; 297/301.4
(58) Field of Search ..... 297/302.4, 303.4, 297/301.4, 300.5; 248/597, 550; 267/177

(56) References Cited

U.S. PATENT DOCUMENTS 4,653,806 A * 3/1987 Willi ..... 297/300
4,709,962 A * 12/1987 Steinmann ..... 297/301
4,830,431 A * 5/1989 Inoue ..... 297/300
5,150,948 A * 9/1992 Volkle ..... 297/301
5,160,184 A * 11/1992 Faiks et al. ..... 297/304
5,918,935 A * 7/1999 Stulik et al. ..... 297/300

* cited by examiner

*Primary Examiner*—Anthony D. Barfield
*Assistant Examiner*—Stephanie Harris
(74) *Attorney, Agent, or Firm*—Koda & Androlia

(57) ABSTRACT

A reclining chair including a support base, a chair seat rotatably coupled at its forward portion to the support base, a substantially vertically disposed coil spring provided adjacent the forward portion of the seat and between the seat and the support base such that the coil spring is pivotally coupled to the seat portion and the support base at its ends, an apparatus for pivoting one end of the coil spring about another end of the coil spring and an offset crank for driving said apparatus.

5 Claims, 18 Drawing Sheets

RECLINING CHAIR

BACKGROUND OF THE INVENTION

1. Field of the Invention

This invention relates to reclining chairs and more particularly, to mechanisms for reclining the seat and back portion of such reclining chairs.

2. Prior Art

In the prior art, there are several different types of reclining chairs. All of these reclining chairs essentially perform the same function. That is the function of reclining; however, these prior art reclining chairs all have certain deficiencies. In particular, when the chairs recline, the feet of the person sitting in the chair rise off the floor as the front portion of the seat rises. Such a condition is particularly undesirable in reclining chairs utilized in offices.

The reclining mechanism is usually further provided with a spring which can be adjusted for preload for varying the biasing force against the reclining motion of the chair so that the chair cannot fall backward with the person in it; however, this spring can be adjusted only for preload and nothing else. Preload adjustability alone does not provide the capability for equal starting positions for large and small persons and does not provide the same feel throughout the range of reclining travel for large and small persons. As a result, chairs with only preload adjustability are optimized essentially for only one size person. Therefore, chairs which are designed for people who are heavy cannot be utilized by people who are light in weight and vice versa.

There does exist reclining chairs in the prior art which reduce or eliminate the first above disadvantage; however, while these prior art reclining chairs may reduce or eliminate this disadvantage, they have other disadvantages of their own. Examples of such disadvantages are that they are complex in structure, difficult and expensive to manufacture and do not feel equally comfortable during reclining motion for both light and heavy weight persons.

Examples of prior art reclining chairs which possess one or more of the above disadvantages and which may have attempted to solve some of the above-described disadvantages are described in the issued patents as follows:

United States:

| | | |
|---|---|---|
| 910,357 | 2,272,980 | 2,479,175 |
| 2,611,420 | 2,616,483 | 2,925,122 |
| 3,856,346 | 4,372,608 | 4,386,805 |
| 4,402,546 | 4,529,247 | 4,650,248 |
| 4,682,814 | 4,684,173 | 4,709,962 |
| 4,779,925 | 4,804,277 | 4,865,384 |
| 4,889,384 | 4,889,385 | 4,892,354 |
| 4,911,501 | 4,962,962 | 5,033,791 |
| 5,046,780 | 5,160,184 | 5,288,138 |
| 5,366,274 | 5,375,912 | 5,582,459 |
| 5,660,439 | | |

German:

DE4220881-A1

SUMMARY OF THE INVENTION

The inventors have invented a mechanism for reclining chairs which overcomes most of the disadvantages of the prior art. This invention is embodied in the U.S. Pat. No. 5,918,935. However, the inventors have now made improvements on their previous invention in order to provide an even superior mechanism.

Accordingly, it is a general object of the present invention to solve the disadvantages described above in the prior art and provide an improved mechanism.

In particular, it is a specific object of the present invention to provide a reclining chair which does not raise the feet of a person who is seated in the chair as it reclines, does not cause discomfort to the person seated in the chair as it reclines, is capable of being utilized equally comfortably by both heavy and lightweight persons, is easier to manufacture, reclines smoother and is easier to adjust.

It is yet another object of the present invention to provide a reclining chair with simultaneous adjustment of both the preload and the spring rate.

It is another object of the present invention to provide a reclining chair which will provide equal performance for a wide size range of persons.

It is still another object of the present invention to provide a reclining chair which includes a mechanism which is relatively simple in structure, easy to manufacture and low in cost to make.

In keeping with the principles and objects of the present invention, the objects are accomplished by a unique reclining chair including a support base, a chair comprising at least a seat portion, a means for coupling a forward portion of the seat portion to the support base such that the seat portion moves substantially about a pivoting axis located adjacent to the forward portion, a substantially vertically disposed coil spring means provided adjacent to the forward portion of the seat portion and between the seat portion and the support base, a means for coupling ends of the coil spring means pivotally to the seat portion and the support base and a means for pivoting one end of the coil spring means about an other end of the coil spring means whereby a force per unit distance of reclining of the seat portion as the chair is reclined may be varied and a reclining chair which is comfortable to sit in by both heavy and lightweight persons is provided.

Still further, in order to provide a means for more easily and quickly adjusting the means for pivoting one end of the coil spring means about the other end of the coil spring means, an offset crank shaft is provided as an improvement over the knob so as to provide more leverage and torque and a more ergonomically desirable motion for quick and easy adjustment of the means for pivoting one end of the coil spring to thereby vary the force per unit distance of reclining of the seat portion. Also, in another embodiment a boomerang shaped bell crank is used which simplifies the mechanism and reduces the load on the offset crankshaft.

BRIEF DESCRIPTION OF THE DRAWINGS

The abovementioned features and objects of the present invention will become more apparent with reference to the following description taken in conjunction with the accompanying drawings wherein like reference numerals denote like elements and in which.

DETAILED DESCRIPTION OF THE INVENTION

Figure 1:
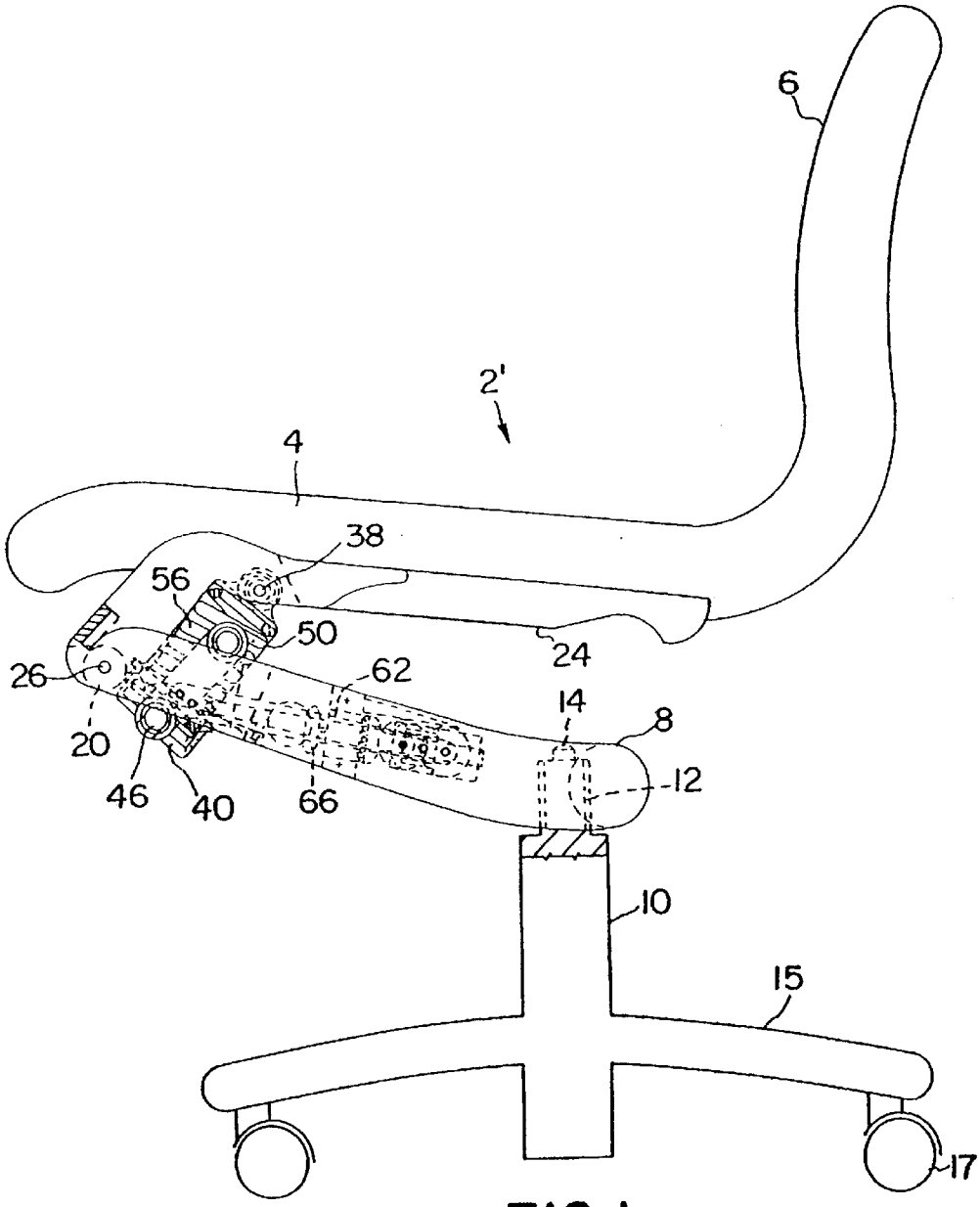
FIG. 1 is a partially cut-away side view of a reclining chair in accordance with the teachings of the present invention.

Referring to FIGS. 1–4, shown therein is a first embodiment of the present invention. In particular, the reclining chair 2 comprises a seat portion 4 and a back portion 6 which are formed integrally. The reclining chair 2 further includes a base 8 which is rotatably coupled to a pedestal 10 by means of a tapered cup 12 which rotatably engages with a tapered pin 14. The pedestal 10 is further provided with legs 15 on which are provided rollers 17. Extending forwardly from the base 8 are two support arms 16 and 18. The forwardly projecting support arms 16 and 18 are further provided at their ends with cylindrical holes 20 into which bearings 22 are inserted.

To the bottom of the seat portion 4 is provided a mounting plate 24. The mounting plate 24 is pivotally coupled to the forward portions of the support arms 16 and 18 by means of a shaft 26 which extends through the bearing 22 and holes in the forward portion of the mounting plate 24. The shaft 26 is provided in parallel to an axis passing through a person sitting in the reclining chair. To the underside of the mounting plate 24 adjacent the forward portion of the mounting plate 24 is provided downwardly projecting tabs 28 and 30. To these downwardly extending tabs 28 and 30 is rotatably coupled an upper spring cup by means of bearings 34, holes 36 and shaft 38. A lower spring cup 40 is mounted to two upwardly projecting arms 42 and 44. This mounting is a rotatable mounting and is affected by means of cylindrical portions 46 which fit into bearings 48 in the arms 42 and 44. The other end of the arms 42 and 44 are respectively connected to the support arm 16 and 18 by means of screws 50 and bearings 52 which fit into holes 54 provided in the ends of the arms 16 and 18. A coil spring 56 is provided between the upper and lower spring cups 32 and 40.

A fixed block 60 is provided between the support arms 16 and 18. The fixed block 60 is provided with a hole 62. Through the hole 62 is a drive shaft 64. One end of the drive shaft 64 is provided with a bevel gear 66. The bevel gear 66 engages with another bevel gear 68 provided at right angles to the bevel gear 66. The bevel gear 68 is provided on a shaft 70 which is supported by arms 72 and 74, and a knob 76 is provided on the end of the shaft 70. The gear ratio between bevel gears 66 and 68 can be set depending on the weight range of the reclining chair 2. The other end of the drive shaft 64 is threaded and is threaded into a movable block 80. Coupled to the ends of the movable block 80 are forwardly extending arms 82 and 84 and rollers 86. The rollers 86 are provided on shafts 88 extending from the ends of the movable block 80. The rollers 86 roll on guides 90. A guide surface 90*a* of the guides 90 is provided in parallel to the threaded portion of the drive shaft 64.

The other ends of the arms 82 and 84 are rotatably coupled to the arms 44 and 42 by means of pins and holes. The coupling point between the arms 82 and 84 and the arms 44 and 42 is located above shaft 46 but below screws 50. In addition, it should be apparent from the figures that the screw 50 is provided at a point above where the arms 44 and 42 are coupled to the arms 82 and 84, but below the position where the upper cup 32 is pivotally mounted to the mounting plate 24. As a result of the arrangement of the three pivoting axises identified by the numerals 38, 50 and 46, the coil spring 56 may be pivoted in its orientation and particularly pivoted to a position which is at some angle to a perpendicular to the mounting plate 24. As the spring cup 40 moves away from the shaft 26, the effective rate of the spring increases. Similarly, as the spring moves closer to the shaft 26, the effective rate of the coil spring 56 will decrease. In particular and referring to FIG. 2, when the spring is oriented in the C position, the effective spring rate and force exerted against the mounting plate 24 will be the highest, and when the spring is moved into the position A, the force or effective spring rate will be the least.

Figure 2:
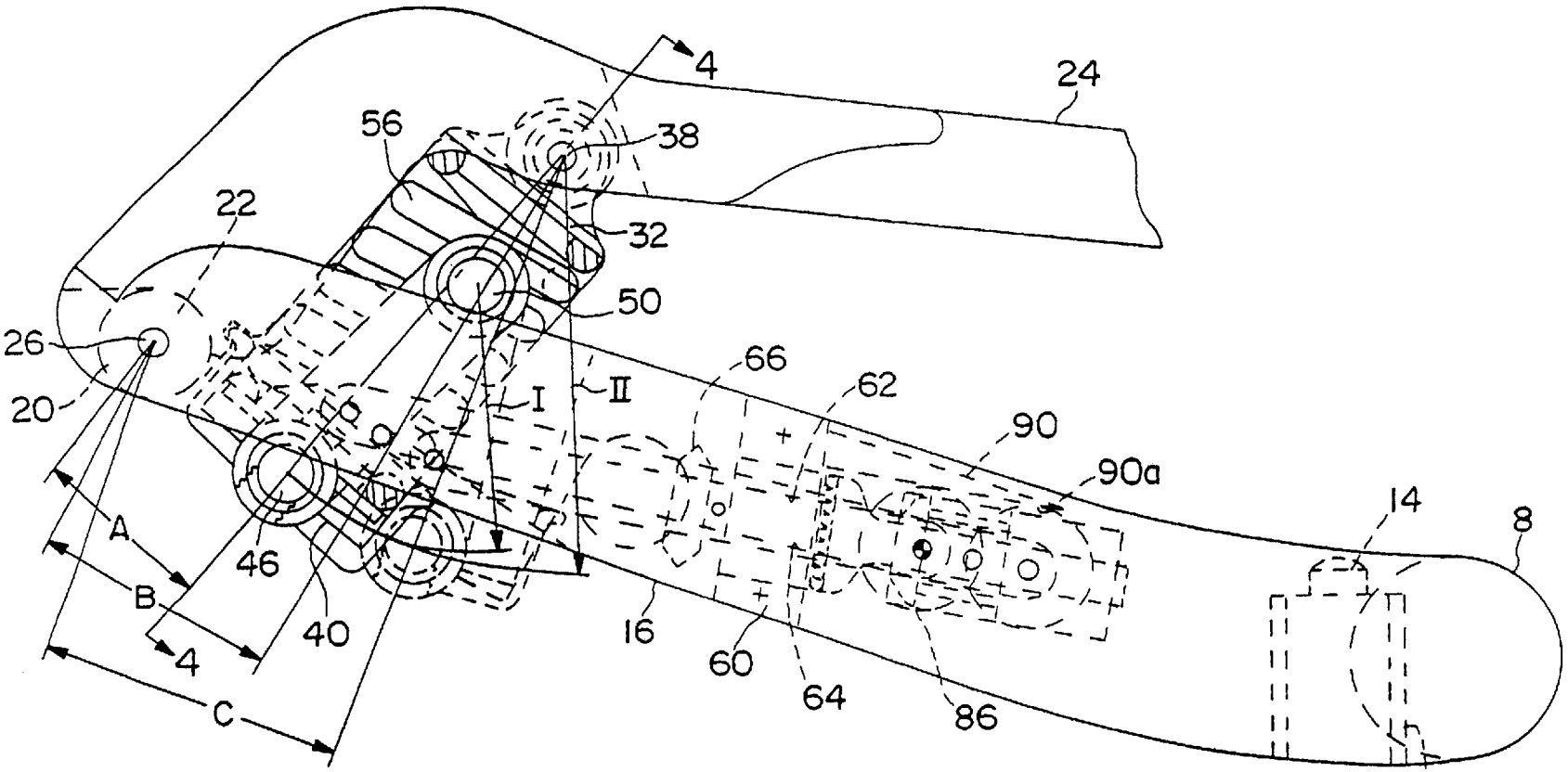
FIG. 2 is an enlarged cross-sectional view of the mechanism of FIG. 1.
Figure 6A:
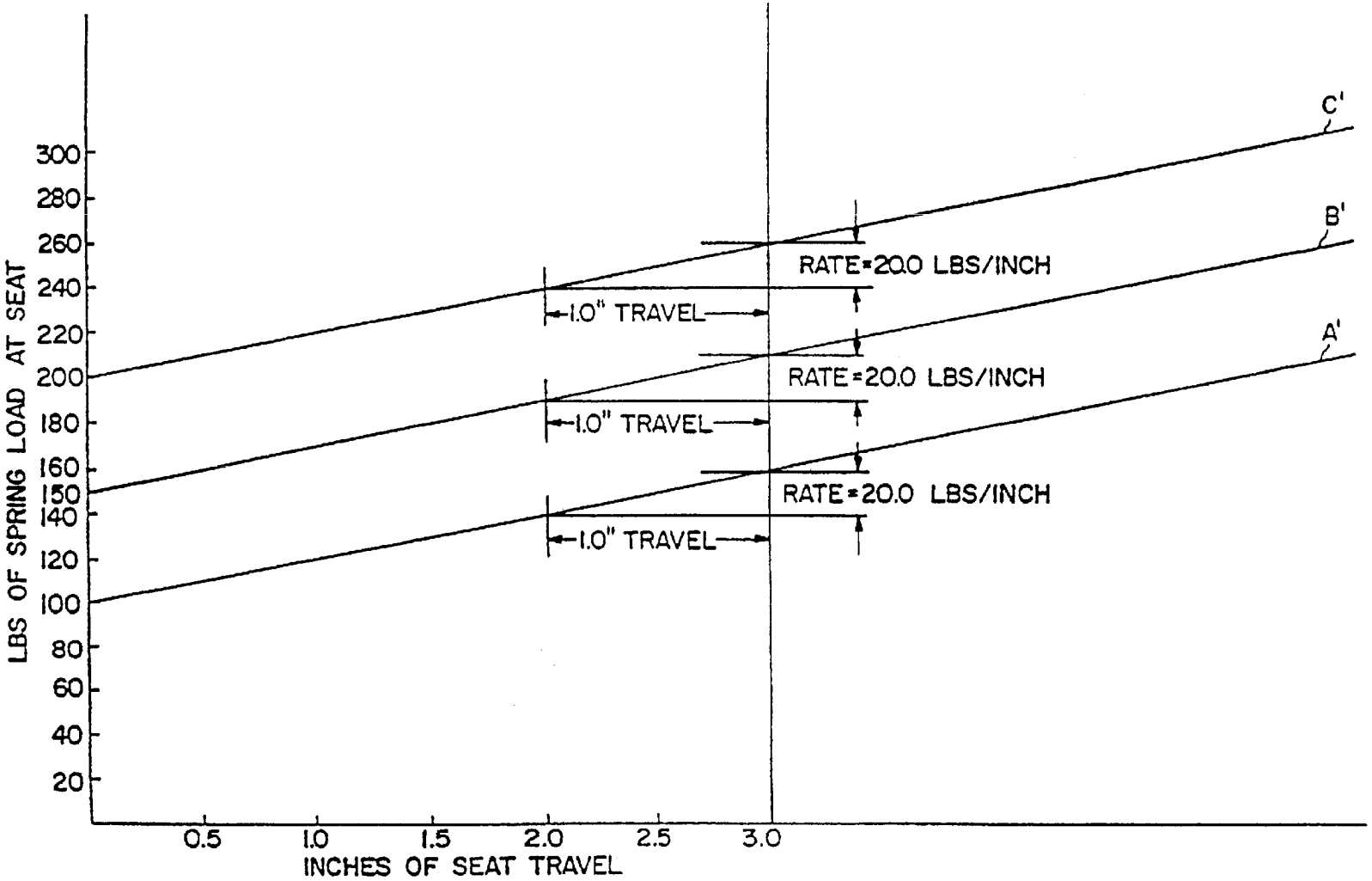
FIGS. 6A, 6B and 6C illustrate respectively load vs. seat travel for a conventional mechanism, load vs. seat travel for the present invention and load curve comparisons for the conventional mechanism and the present invention.
Figure 6B:
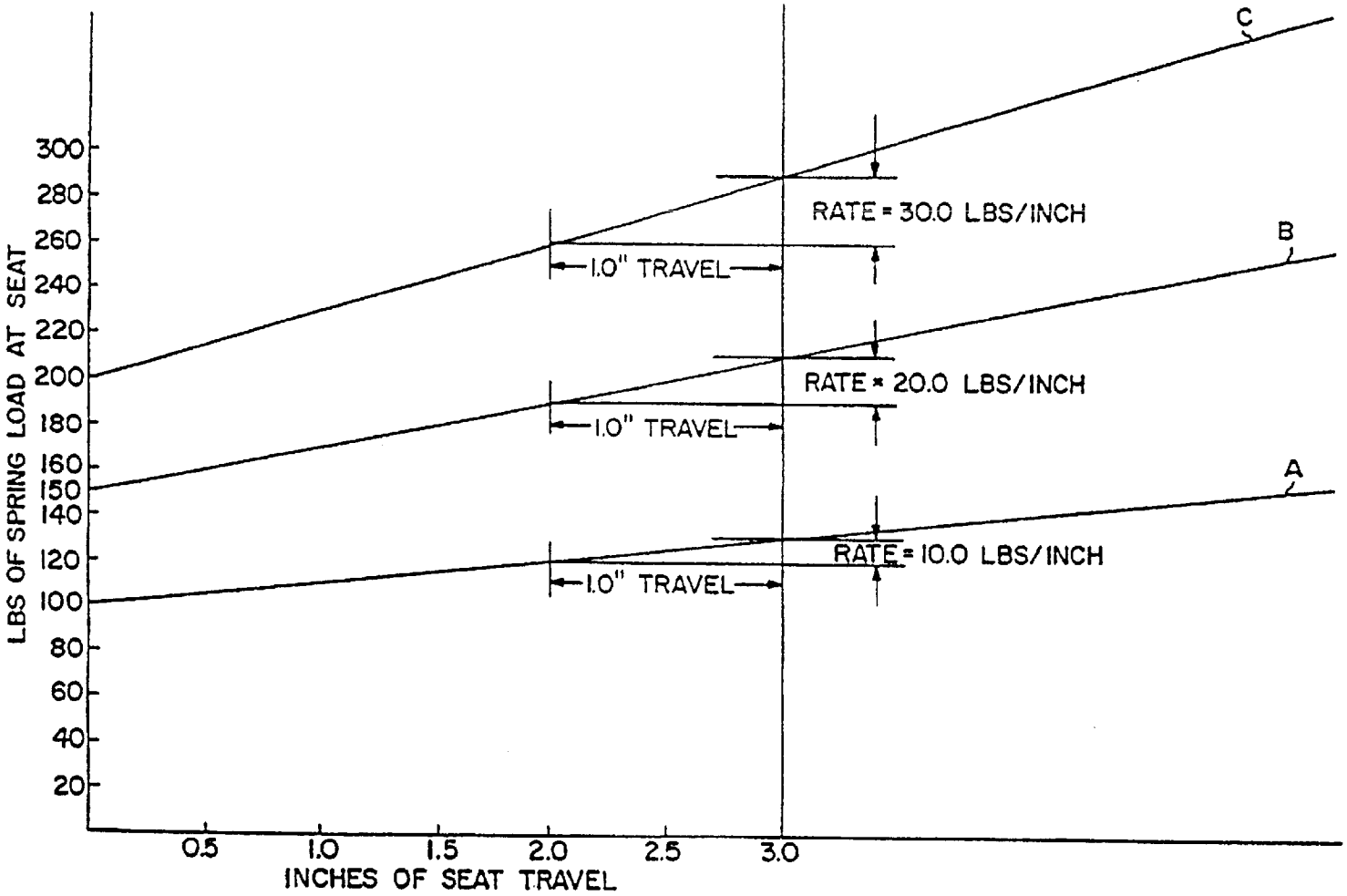
Figure 7A:
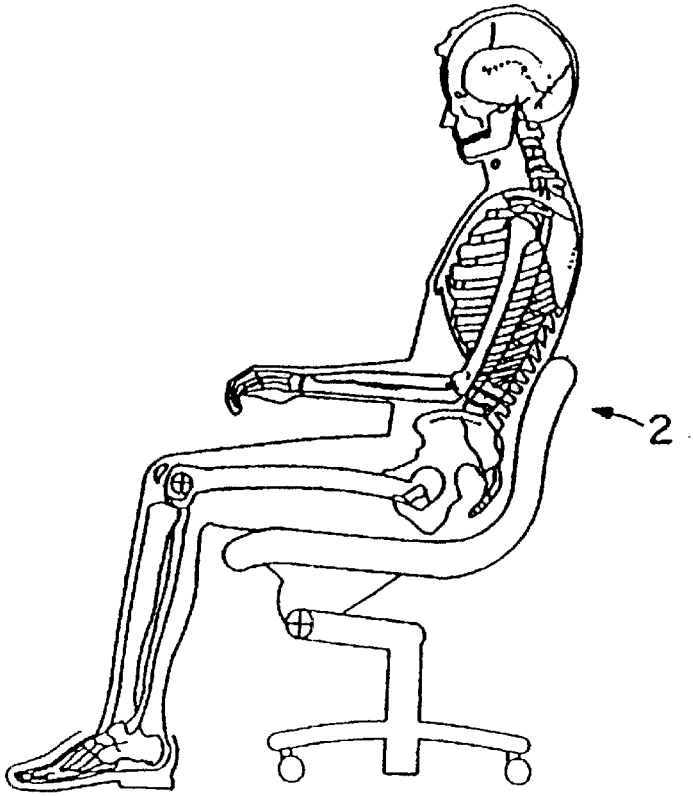
FIGS. 7A and 7B are simplified views illustrating the reclining motion of the present invention.
Figure 7B:
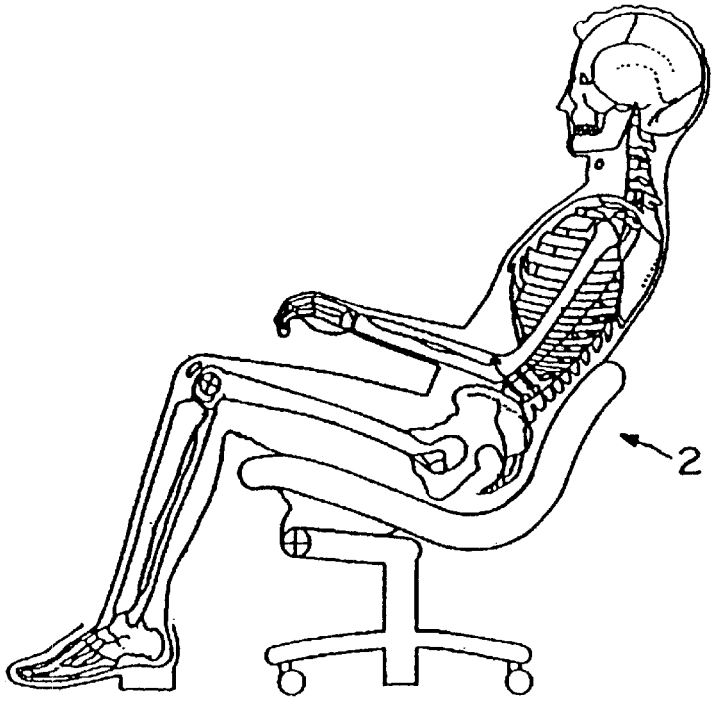

In operation, an individual sits in a reclining chair as is illustrated in the FIG. 7A. Since the pivot point formed by the shaft 26 is provided parallel to an axis passing through a knee joint of a person sitting in the chair 2, the chair 2 reclines about an axis provided in parallel to an axis extending through the knee joint of a person seated in the reclining chair 2 and reclines without raising the person's feet from the floor or causing the person discomfort, as is shown in FIGS. 7B. Still further and as shown in FIG. 2, since the distance from the shaft 26 of the coil spring 56 changes by rotating knob 76 and thereby moving movable block 80, the effective spring rate of the coil spring 56 can be changed. As a result, the effective spring rate of the coil spring 56, which generates an opposing force as the chair 2 is reclined, can be varied. This variation is shown in FIG. 6B. As is shown in FIG. 6B, as the bottom end of the spring 56 moves from B to C in FIG. 2, the effective spring constant, or in other words the force per unit travel of the spring as it is compressed, is statically variable and increases variably. Alternately, as the bottom end of the spring 56 is moved to position A in FIG. 2, the effective spring constant is a minimum. As a result and as is shown in FIG. 7B, the effective spring rate increases from the soft setting at the distance A of approximately 10 lbs. per inch of travel to 20 lbs. per inch of travel for the medium setting at the distance B, and then to the rate of 30 lbs. per inch for the hard setting shown by C in FIG. 6B. In comparison thereto, in FIG. 6A is shown the conventional soft, medium and hard settings A', B' and C', respectively. In all cases, the rate is a constant 20 lbs. per inch of travel. Accordingly, it should be apparent that the conventional system is essentially optimized to be utilized only for the medium setting.

Figure 6C:
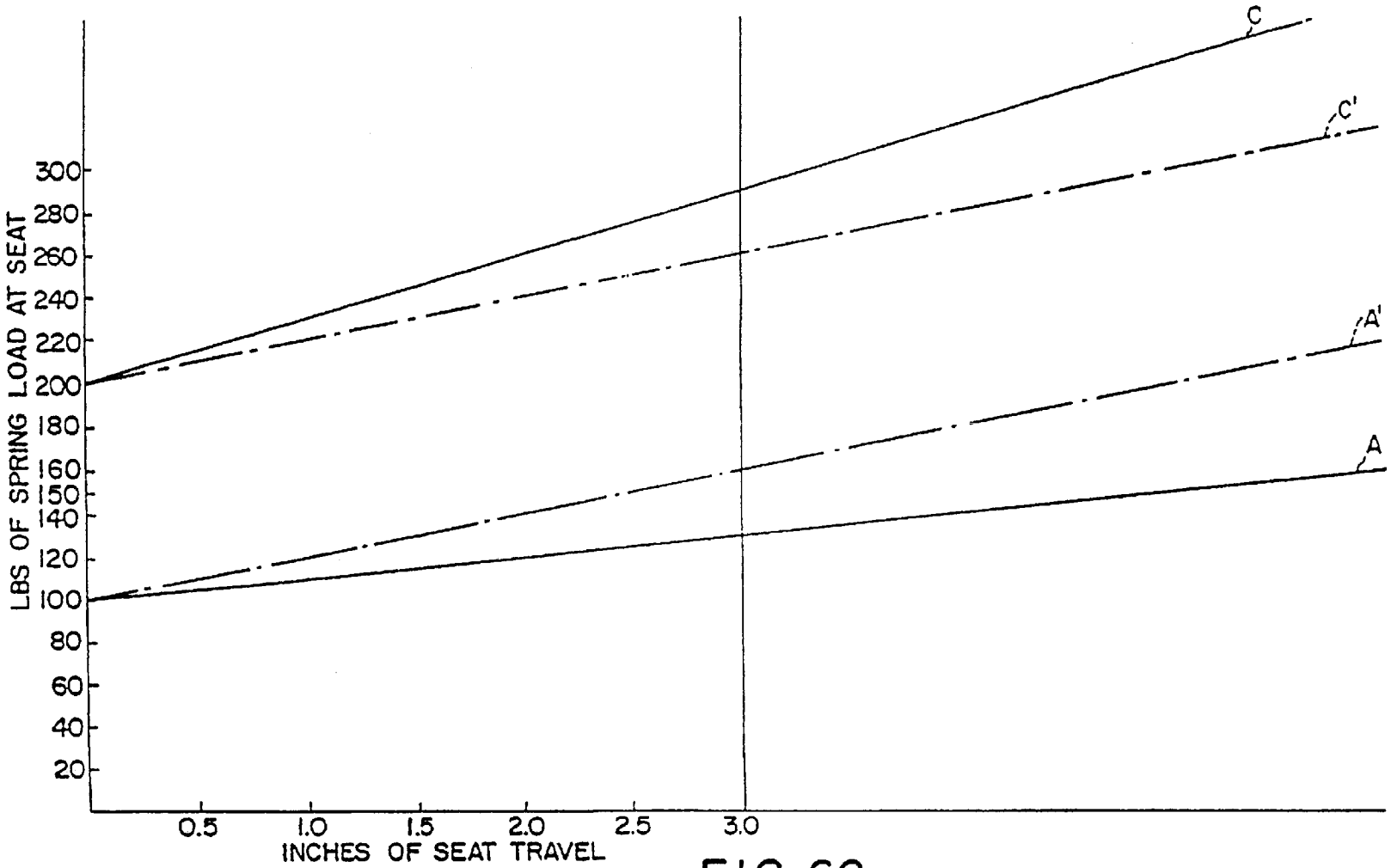

Still further and as is apparent from FIG. 2, the center of rotation of the coil spring 56 about shaft 38 is different or displaced from the center of rotation of the arms 42 and 44 about screw 50. This difference or displacement results in two different radiuses of movement I and II. The difference in these radiuses I and II increases as the coil spring 56 is rotated towards the vertical orientation and results in producing a variation in the preload on the reclining chair 2 which is simultaneous with the changes in the effective spring rate. The importance of this simultaneous variation in the preload with the change in the effective spring rate is apparent from the FIG. 6C. Looking first at the line A which represents the effective biasing force of the spring per inch of travel of the seat of a reclining chair incorporating the present invention and comparing it with the dashed line A' which illustrates the biasing force of a spring of a conventional reclining chair. As is apparent from comparing the lines A and A', as the seat of the reclining chair is reclined, the biasing force for the soft setting becomes too hard with the conventional design. Alternately, looking at the line C which represents the hard setting for the distance or position C in FIG. 2, the present invention and the dash line C' which represents the hard setting for a conventional chair, it should be apparent that as the conventional chair is reclined, the biasing force becomes too soft. As a result in either case, the individual sitting in the chair becomes uncomfortable the more the chair is reclined with the conventional chair. Therefore, with the construction of the present invention, by rotating the knob 76 to simultaneously vary the preload and effective spring rate, the reclining chair 2 can be made to recline comfortable for persons over a range of approximately 90 lbs. to 290 lbs, or in other words of a weight ratio of 3:1.

Figure 5:
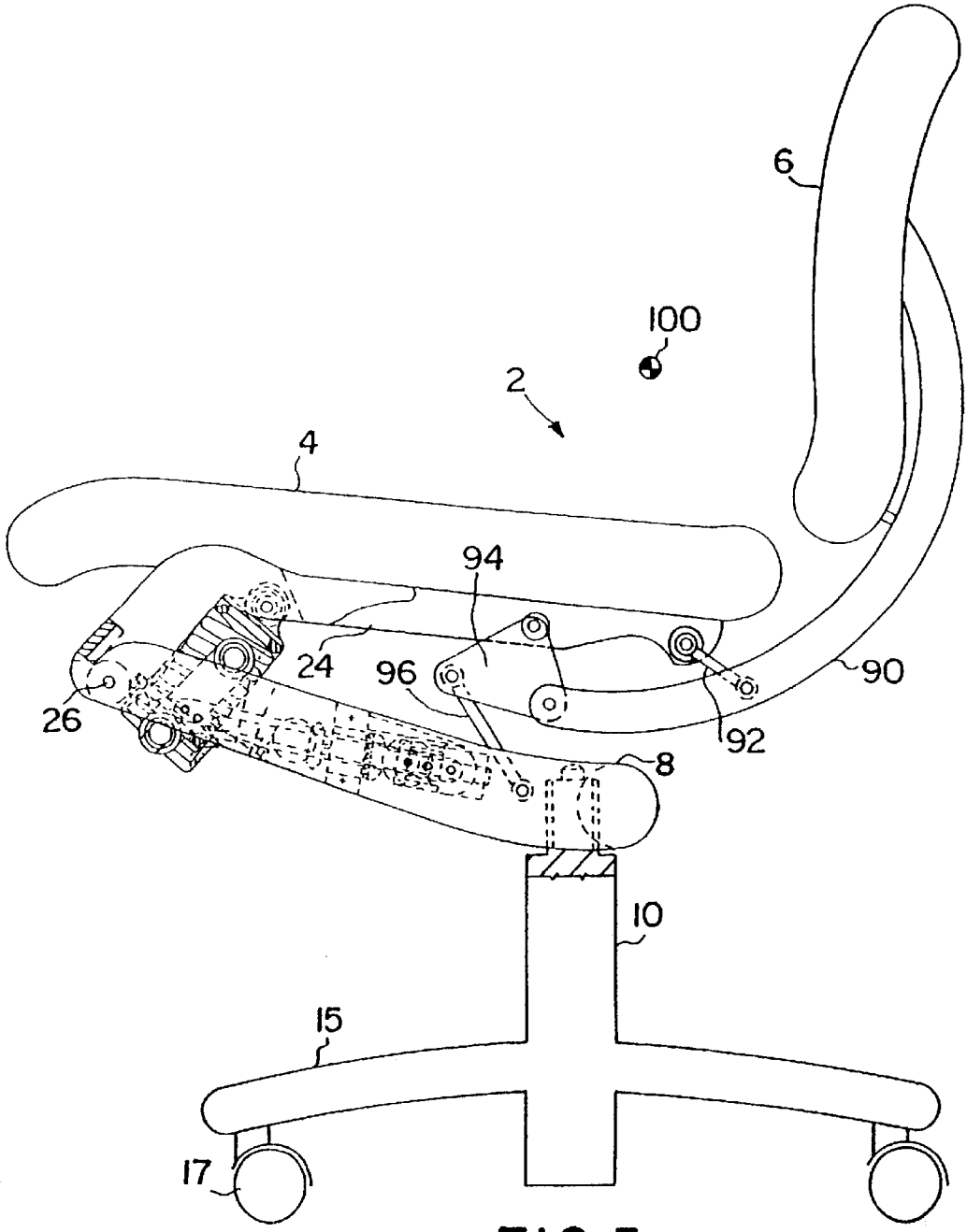
FIG. 5 is a partially cut-away side view of a second embodiment of a reclining chair in accordance with the teachings of the present invention.
Figure 9:
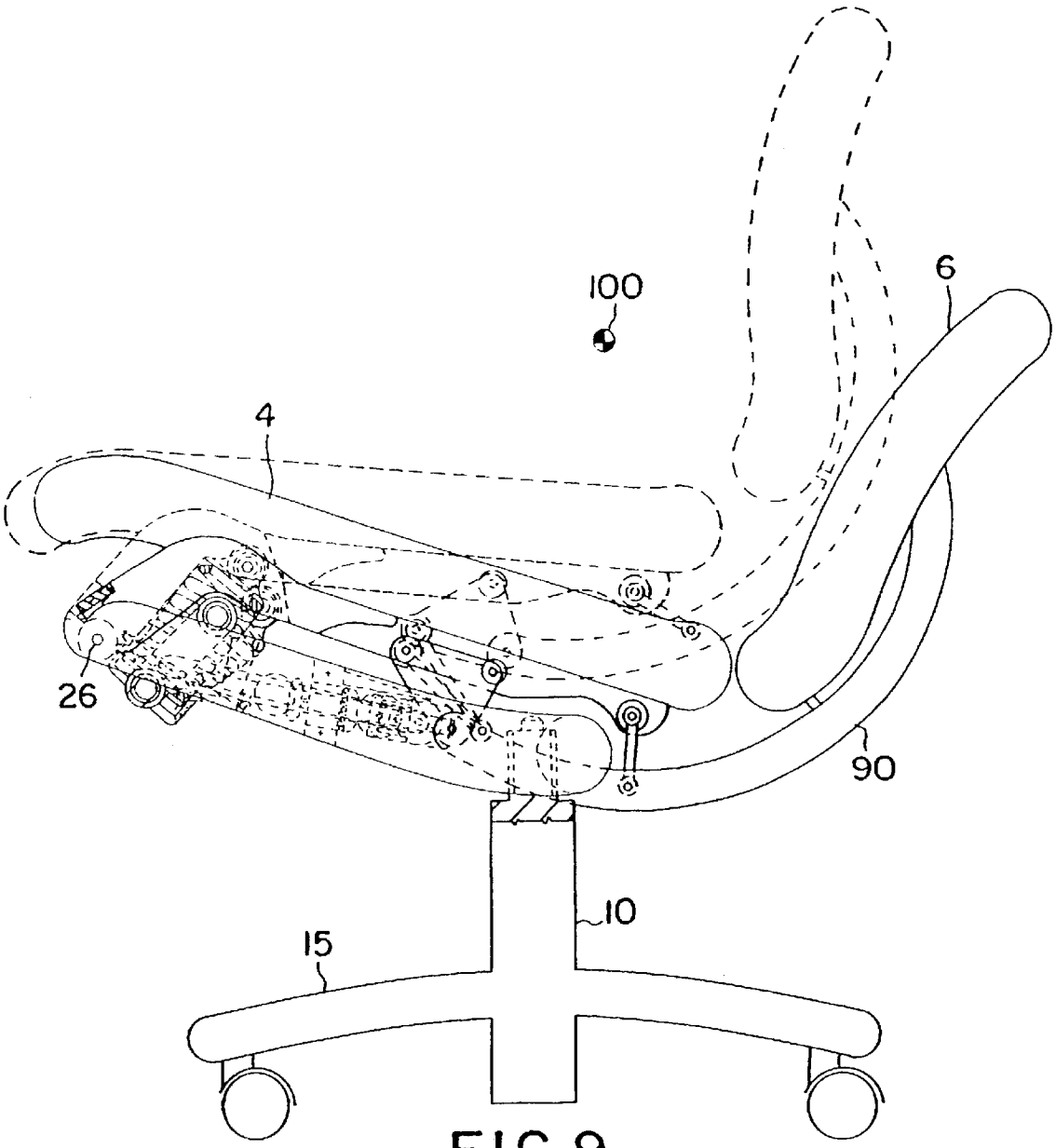
FIG. 9 is a partially cut-away side view of the second embodiment of FIG. 5 illustrating the reclined and unreclined position of the components of the present invention.

Looking next at FIGS. 5 and 9, shown therein is a second embodiment of a reclining chair 2' in accordance with the teachings of the present invention. However, in this reclining chair 2' the seat portion 4 and the back portion 6 are provided independently. The remainder of the elements of the chair 2' operate and are connected together in exactly the same way as in the first embodiment of FIGS. 1–4.

Looking particularly at FIGS. 5 and 9, the reclining chair 2' further includes an intermediate curved link 90. The curved link 90 is pivotally coupled to the support plate 24 by means of an upper link 92 and a triangular plate 94. Particularly, one corner of the triangular plate 94 is coupled to the mounting plate 24, one corner of the triangle is coupled to the curved link 90 and the third corner of the triangle is coupled to the base 8 by means of a link 96. The intermediate curved link 90 is also fixedly connected to the seat back 6 at at least one point.

Figure 8A:
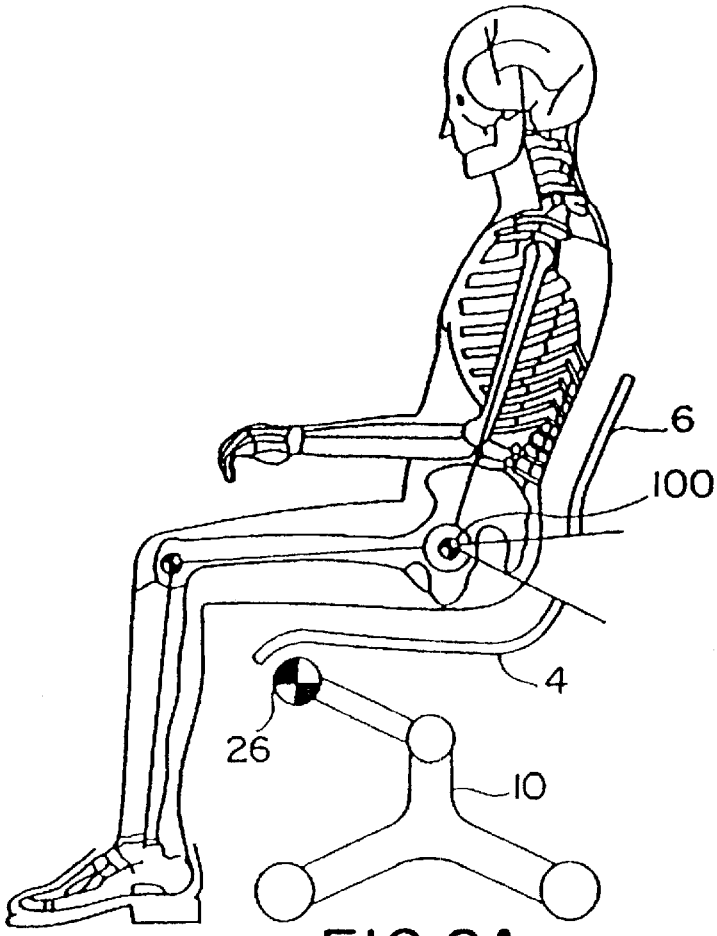
FIGS. 8A and 8B are simplified views illustrating the reclining motion of the second embodiment of the present invention shown in FIG. 5.
Figure 8B:
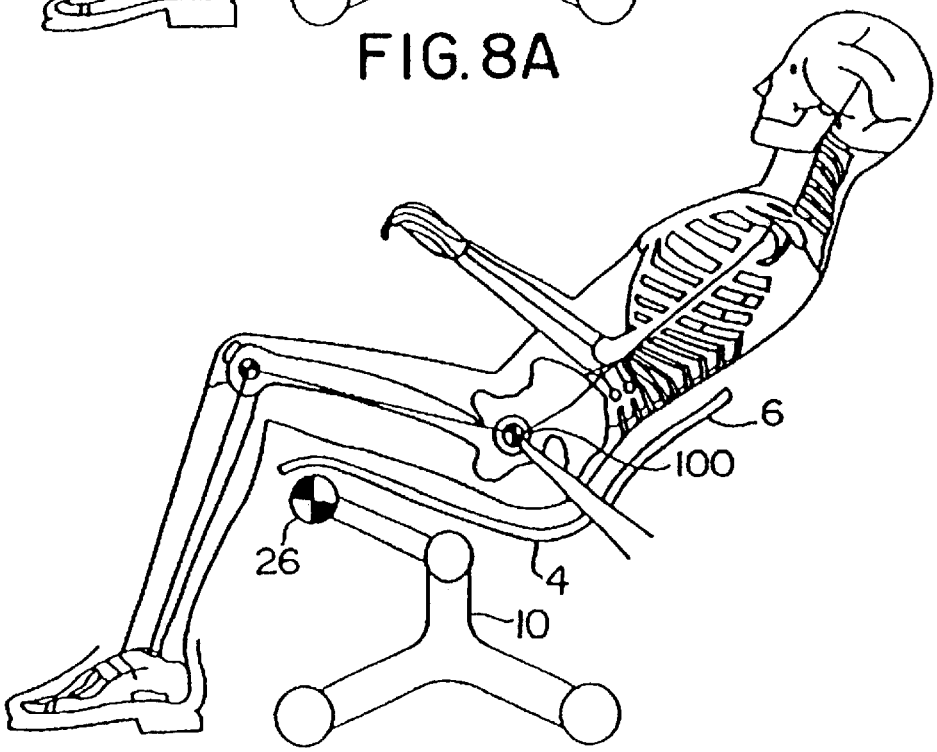

The mechanism comprising the curved link 90, the links 92 and 96 and the triangular plate 94 cause the seat back 6 to recline or pivot about a point 100 in the proximity of the hip of a person seated in the reclining chair 2 as the seat 4 is downwardly pivoted about the shaft 26. Accordingly, the shapes and lengths of the links 90, 92 and 96 and the triangular plate 94 are selected such that the intermediate curved link 90 rotates about a constant radius centered about the point 100 in the proximity of the hip of a person seated in the chair. Therefore, as the seat portion 4 of the reclining seat 2' is reclined, the seat back 6 will rotate about the point 100 in the proximity of the hip of a person sitting in the seat as shown in FIGS. 8A and 8B and further contribute to the comfort of a person sitting in the reclining chair 2' by reducing the shear motion.

Figure 10:
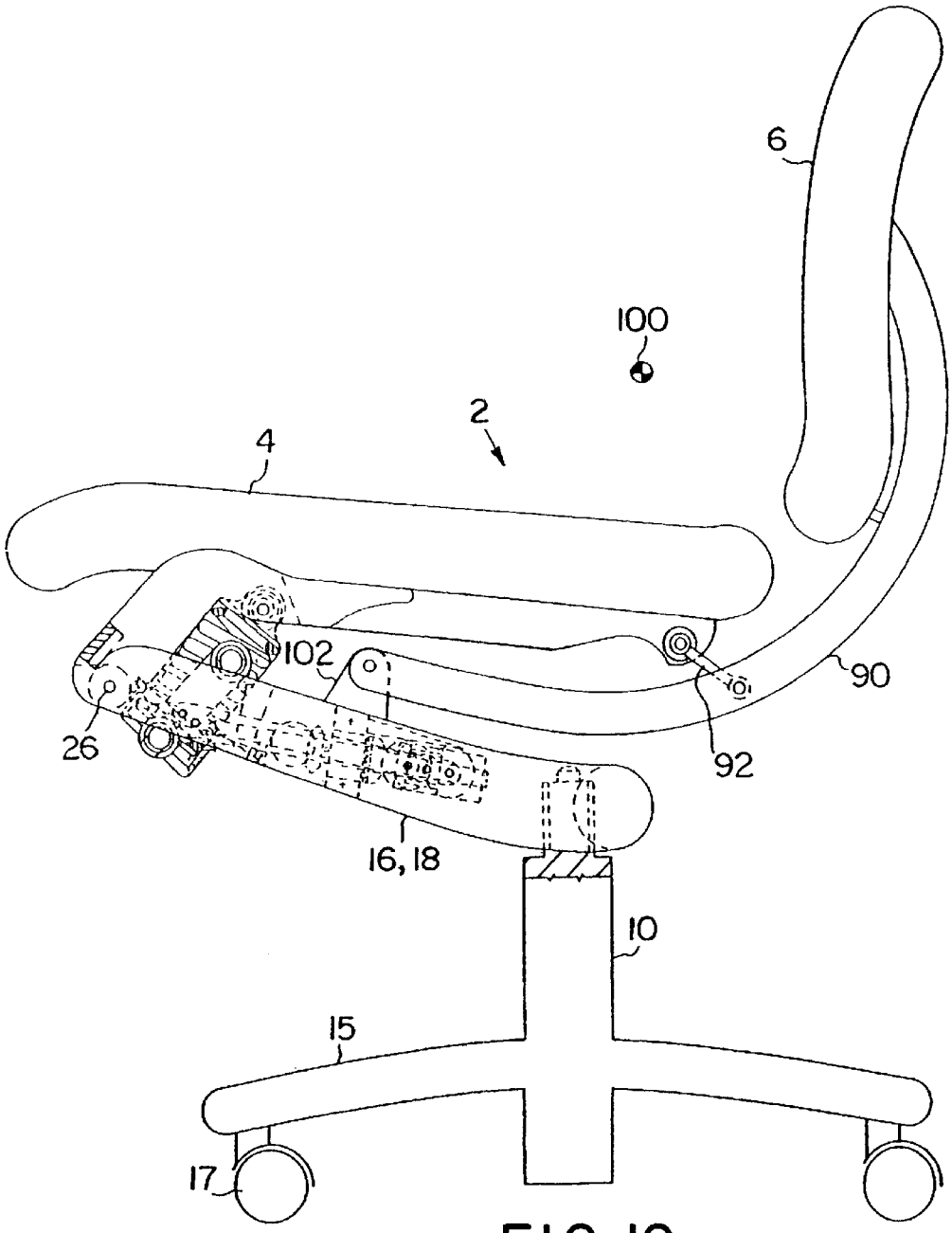
FIGS. 10, 11 and 12 are partially cut-away side views of third, fourth and fifth embodiments similar to the second embodiment of FIG. 5.

Referring to FIG. 10, shown therein is a third embodiment similar to that of FIG. 5. In this third embodiment, like elements are denoted by like reference numerals and function substantially the same as they do in FIG. 5. However, the structure of FIG. 10, while performing the same function as FIG. 5, is constructed differently. In particular, instead of coupling the bottom end of the curved link 90 to the seat 4 by means of a triangular plate, the lower end of the curved link 90 is pivotally coupled to the support arms 16 and 18. As in second embodiment of FIG. 5, as the seat 4 is reclined, the seat back 2 reclines or pivots about a point 100 in the proximity of the hip of a person seated in the reclining chair 2 as the seat 4 is downwardly pivoted about the shaft 26. Accordingly, the shapes and lengths of the links 90 and 92 and the placement of the support 102 are selected such that the intermediate curved link 90 rotates about a radius centered about a point 100 in the proximity of the hip of a person seated in the chair. Accordingly, the third embodiment of FIG. 10 executes substantially the same movement as the second embodiment of FIG. 5 as the seat 4 is reclined.

Figure 11:
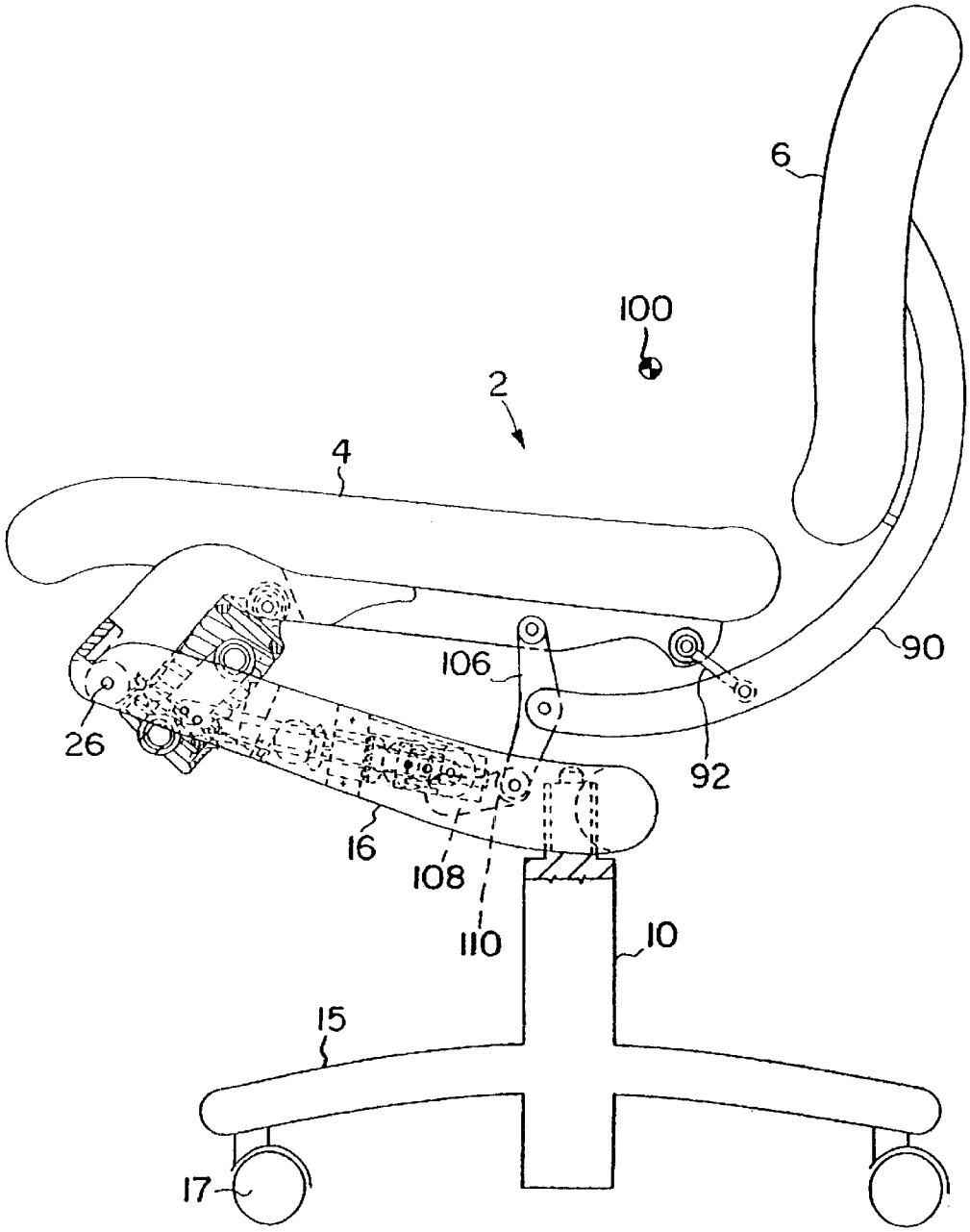

Referring the FIG. 11, shown therein is a fourth embodiment of the present invention. Again, this fourth embodiment of the present invention performs substantially the same function as the second embodiment of FIG. 5 and like elements are given like reference numerals and function substantially the same. In addition, in the fourth embodiment of FIG. 11, the lower end of the curved link 90 is connected to a boomerang-shaped plate 106. The upper end of the boomerang-shaped plate 106 is pivotally coupled to the seat 4 and the lower end of the boomerang-shaped plate 106 is provided in a guide groove 108 provided in support arm 116 by means of a roller 110. Similar to the mechanisms of the second and third embodiments, the mechanism of the fourth embodiment comprising the curved link 90, the link 92, the boomerang-shaped plate 106 and the guide groove 108 cause the seat back 6 to recline or pivot about a point 100 in the proximity of the hip of a person seated in the reclining chair 2 as the seat 4 is downwardly pivoted about the shaft 26. Accordingly, the shapes and lengths of the links 90 and 92 and the boomerang-shaped plate 106 and guide groove 108 are selected such that the curved link 90 rotates about a radius centered about the point 100 in the proximity of the hip of a person seated in the chair.

Figure 12:
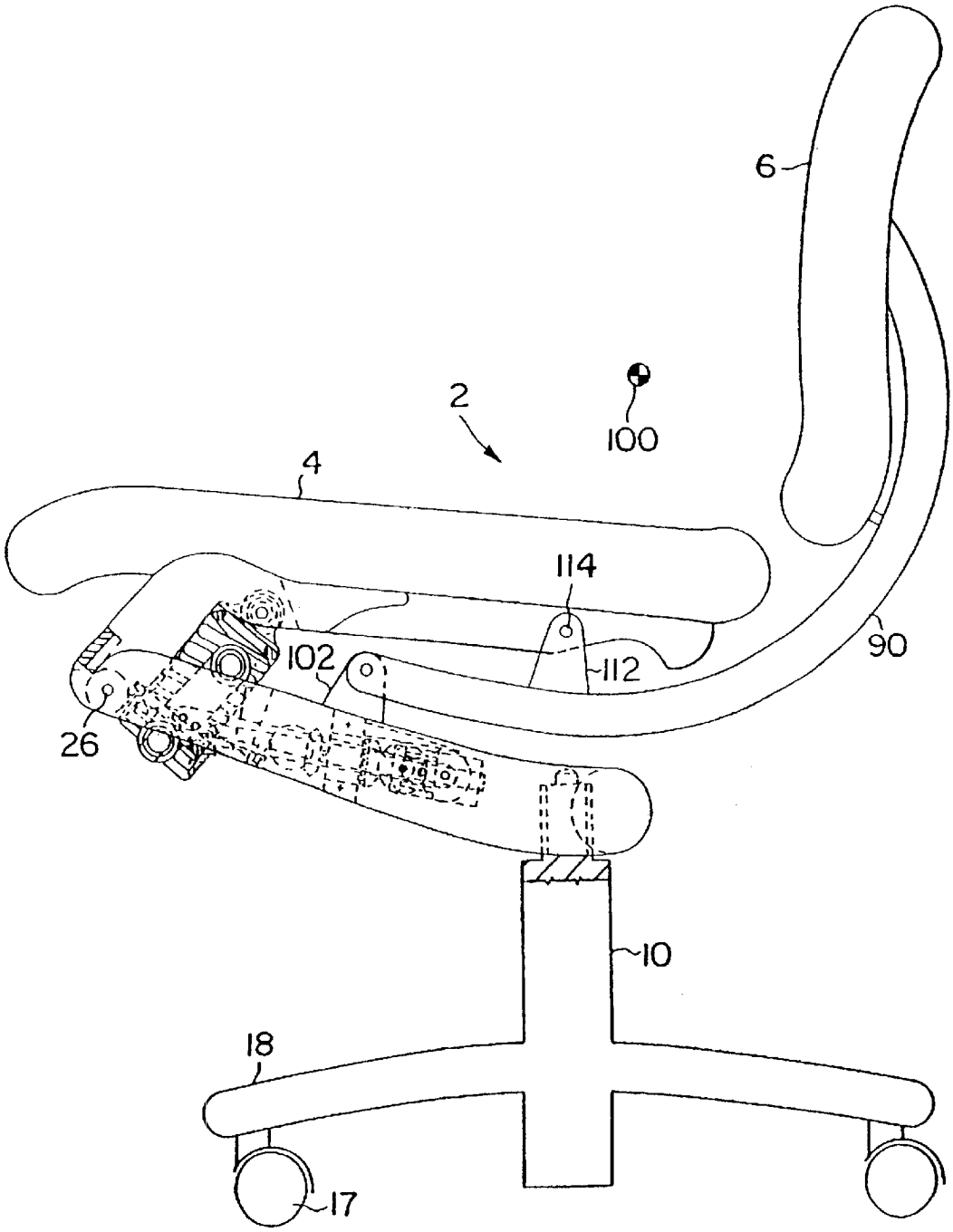

Referring the FIG. 12, shown therein is a fifth embodiment of the present invention. This fifth embodiment is similar to, and performs the same function as, the second third and fourth embodiments previously described. Therefore, those elements of the fifth embodiment which are the same as the elements in the second, third and fourth embodiments are given like reference numerals and function substantially the same way. However, instead of having a link 92 as in the third embodiment, in this fifth embodiment an upwardly extending support plate 112 is provided in the curved link 90. This upwardly extending plate 112 is pivotally connected at 114 to the seat 4.

This mechanism of the fifth embodiment performs substantially the same function as that of the second, third and fourth embodiments and comprises the curved link 90, upwardly extending support plate 112 and support plate 102. This mechanism allows the seat back 6 to recline or pivot about a point 100 in the proximity of the hip of a person seated on the chair 2 as the seat 4 is downwardly pivoted about the shaft 26. Accordingly, the lengths and placement of the supports 102 and 112 and the pivot 114 are selected such that the intermediate curved link 90 rotates about a radius centered about the point 100 in the proximity of the hip of the person seated in the chair.

Figure 3:
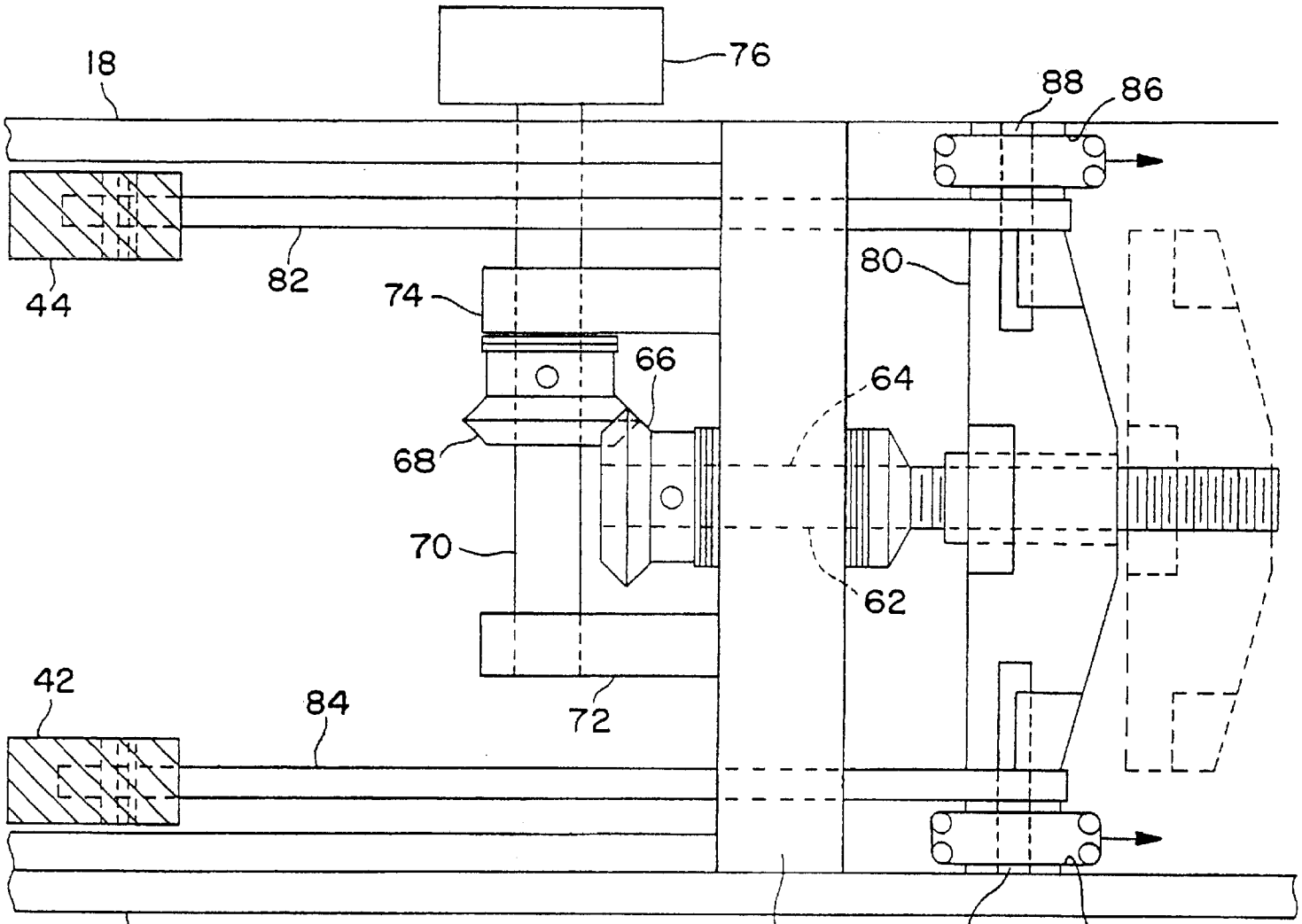
FIG. 3 is a top view of a portion of the mechanism of FIG. 1 with the chair portion removed.
Figure 4:
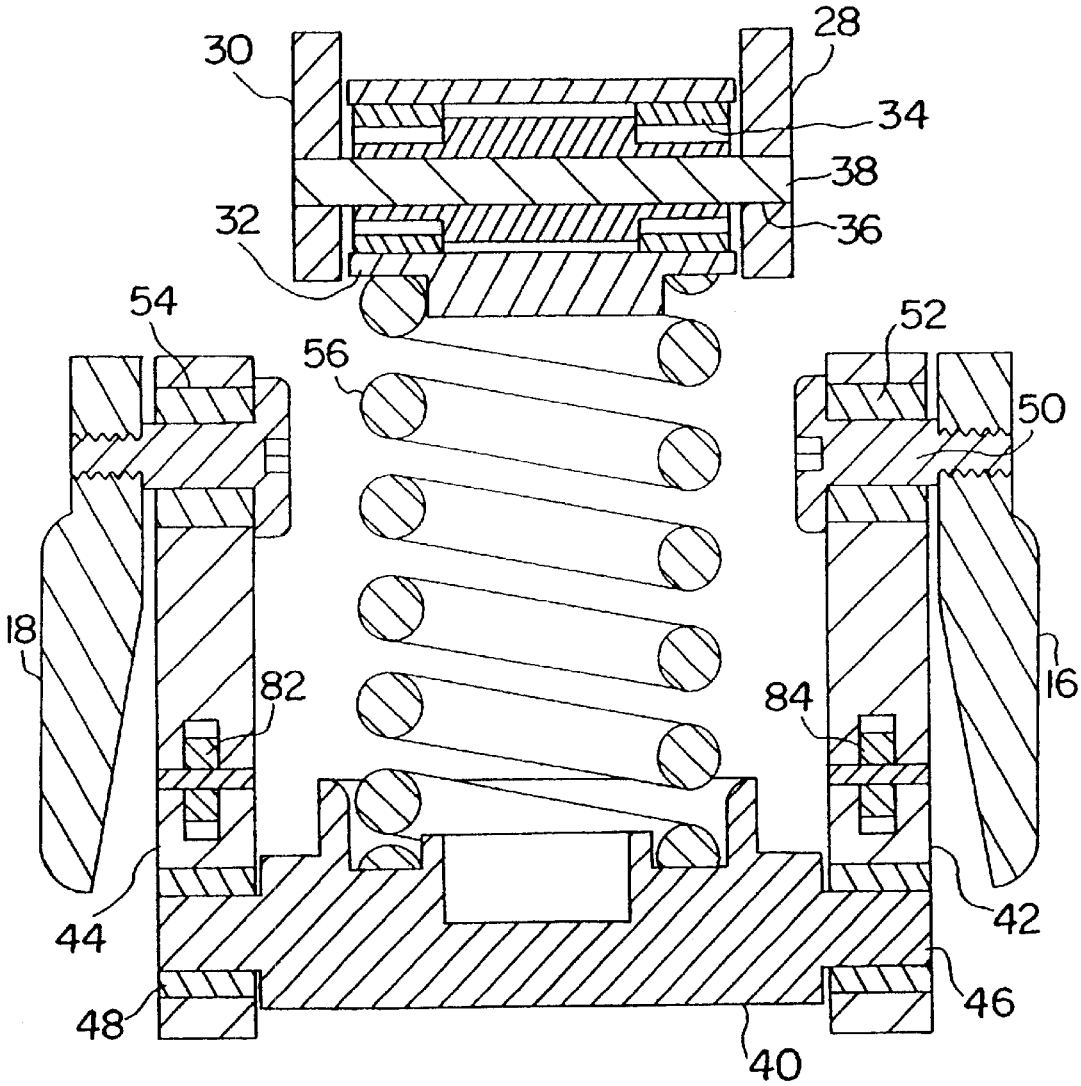
FIG. 4 is a cross-section of FIG. 2 along the lines 4—4.
Figure 13:
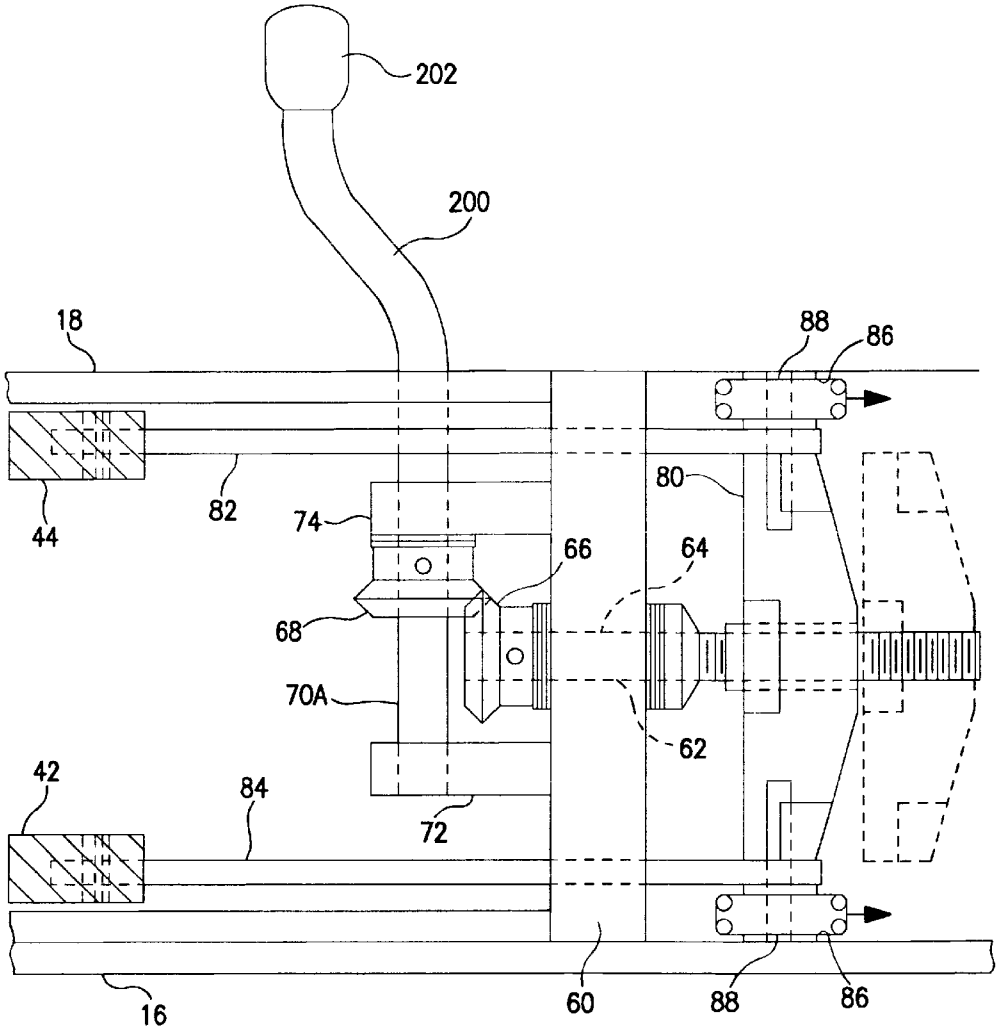
FIG. 13 is another embodiment of the present invention illustrating an improvement on the embodiment of FIG. 3 above.

Referring to FIG. 13, shown therein is another improved embodiment of the present invention wherein the adjustment knob 76 shown in FIG. 3 is replaced by an offset crank 200 and a knob 202 is rotatably coupled to the crank 200. The crank 200 is provided as part of the modified shaft 70A. In all other manners, the construction of FIG. 13 is substantially the same as FIG. 3 and operates in the same manner except for the utilization of the crank.

By the utilization of the offset crank 20, the leverage or torque applied to the shaft 70A and in turn applied to pivoting the bottom cup 40 of the mechanism is increased. In particular, the offset crank 200 provides a very low force spinning motion during the adjustment of the force per unit distance of reclining of the seat portion. Still further, by the utilization of the offset crank 200 and knob 202, a more ergonomically desirous motion is provided which makes the adjustment in the mechanism more quick and easy.

Figure 14:
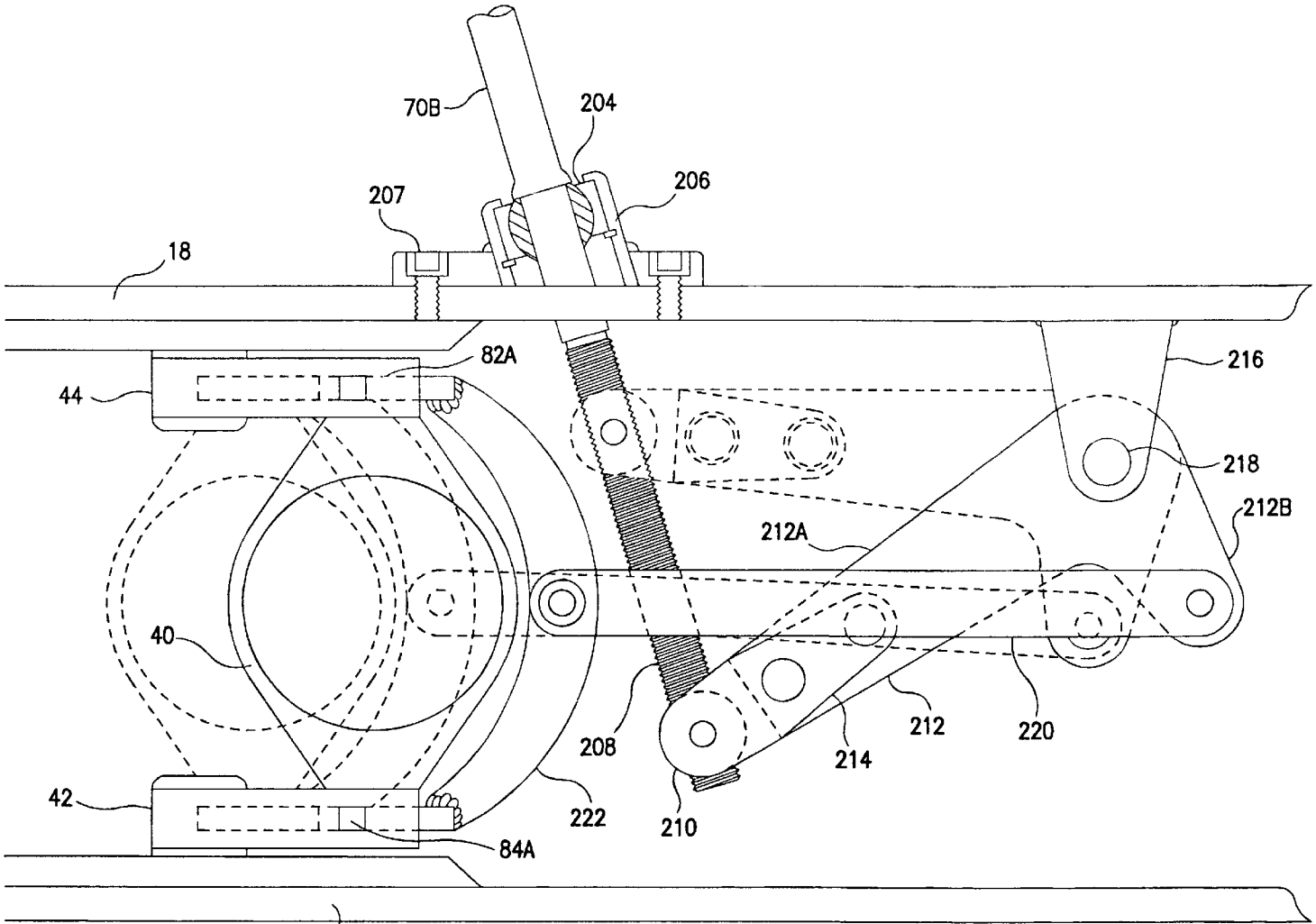
FIG. 14 is a top view illustrating another embodiment for an improved mechanism for pivoting the bottom spring cup of the mechanism of the present invention.

Referring to FIG. 14, shown therein is an improved mechanism for performing the same function as the mechanism shown in FIG. 3. However, this mechanism is simplified and generally makes the adjustment of the mechanism easier and smoother.

In particular, a modified shaft 70B extending at any angle out through the support arm 18 is provided. This shaft 70B is further provided with an offset crank 200 and knob 202 as in the embodiment shown in FIG. 13. The shaft 70B is supported by a bearing 204 which is held in a thrust-bearing cup 206 which is mounted to the support arm 18 by any conventional means such as screws 207. The opposite end of the modified shaft 70B is provided with a threaded portion 208 which is threaded into a trunian 210 which is rotatably coupled to a bell crank 212 by means of a bracket 214 fixed to the bell crank 212. The bell crank 212 is rotatably supported on a bracket 216 at a pivot 218 by conventional means such as a bearing, bolt and nut.

The bell crank 212 is essentially shaped in a boomerang shape with the long arm 212A of the boomerang coupled via the trunian 210 to the threaded end 208 of the shaft 70B. The apex of the boomerang between the two arms is rotatably coupled to the point 218 of the bracket 216. The short arm 212B of the bell crank 212 is coupled to a pair of pull and push links 220. The pair of push and pull links 220 are rotabably coupled to the short arm of the bell crank 212 by conventional means such as a bearing, nuts and bolts. Utilizing the boomerang shaped bell crank 212, the long arm 212A provides increased leverage over the short arm 212B with the result that the turning force at the knob 202 on the off set crank 200 is lowered. Therefore, the mechanism can be adjusted more easily and smoothly. Still further, by setting the ratio of the length of the long arm 212A to the short arm 212B and arranging the bell crank 212 to be rotated towards the higher effective spring constant, the adjustment force on the knob 202 can be made substantially constant.

The other end of the push and pull links 220 are coupled to a yoke 222. The yoke 222 is curvilinear in shape so as to fit around the lower spring cup 40. The ends of the yoke 222 are provided with arms 82A and 84A which are coupled to the arms 42 and 44, respectively, in substantially the same way as in FIG. 3.

In operation, the offset crank 200 is rotated by means of grasping the knob 202 to drive the shaft 70B. The threaded end 208 of the shaft 70B threads into the trunion 210 causing the bell crank 212 to move toward the support 18 as is shown in dotted lines in FIG. 14. As the bell crank 212 rotates about the pivot 218, the yoke 222 together with the bottom spring cup 40 are moved forward as is shown by the dotted lines in FIG. 14.

By means of operating the shaft 70B by turning the offset crank 200, the load vs. seat travel (effective spring constant) which is shown in FIG. 6B can be achieved. Still further, utilizing the mechanism of FIG. 14, the simultaneous variation in preload with change in effective rate shown in FIG. 6C can also be achieved. Accordingly, utilizing the simpler mechanism of FIG. 14, all of the advantages of the present invention can be achieved.

Figure 15:
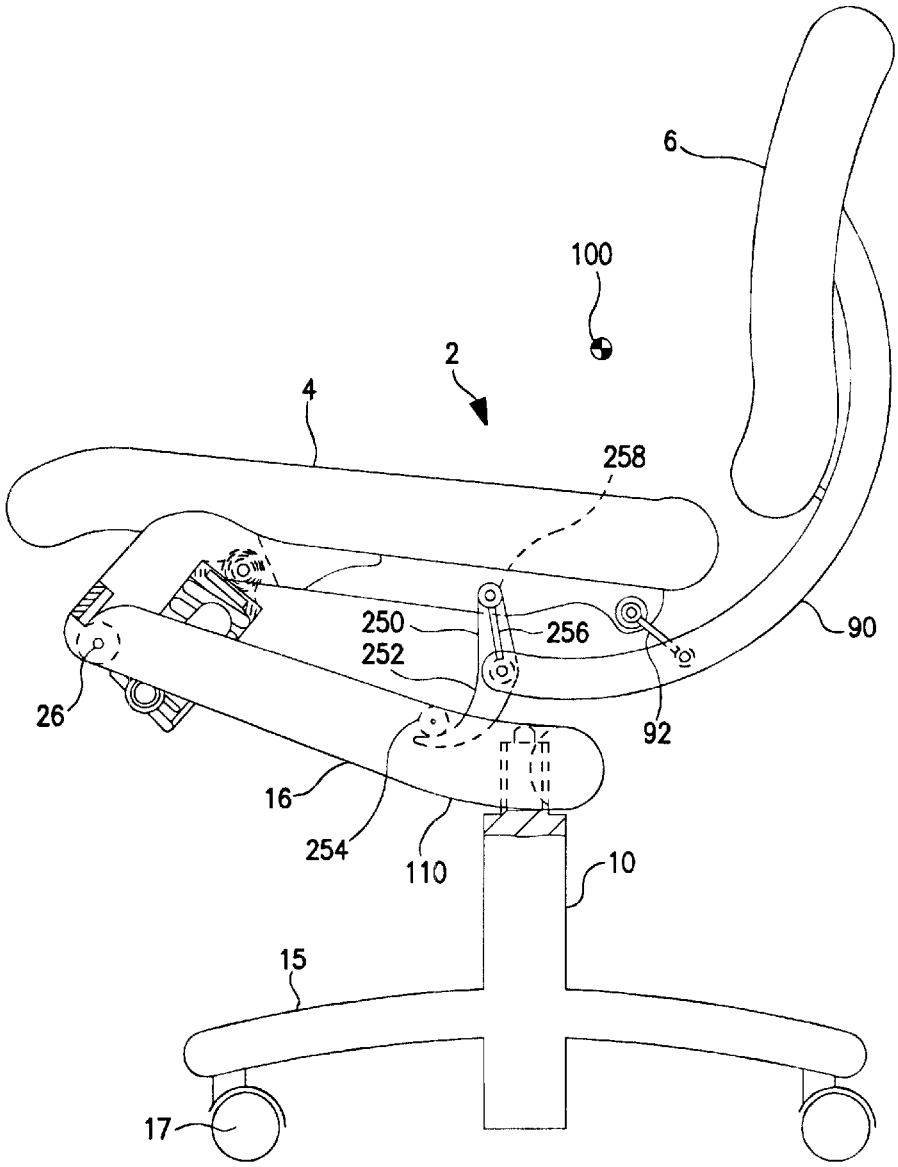
FIGS. 15 and 16 illustrate another improved embodiment of the present invention shown with the back in the unreclined and reclined positions, respectively.
Figure 16:
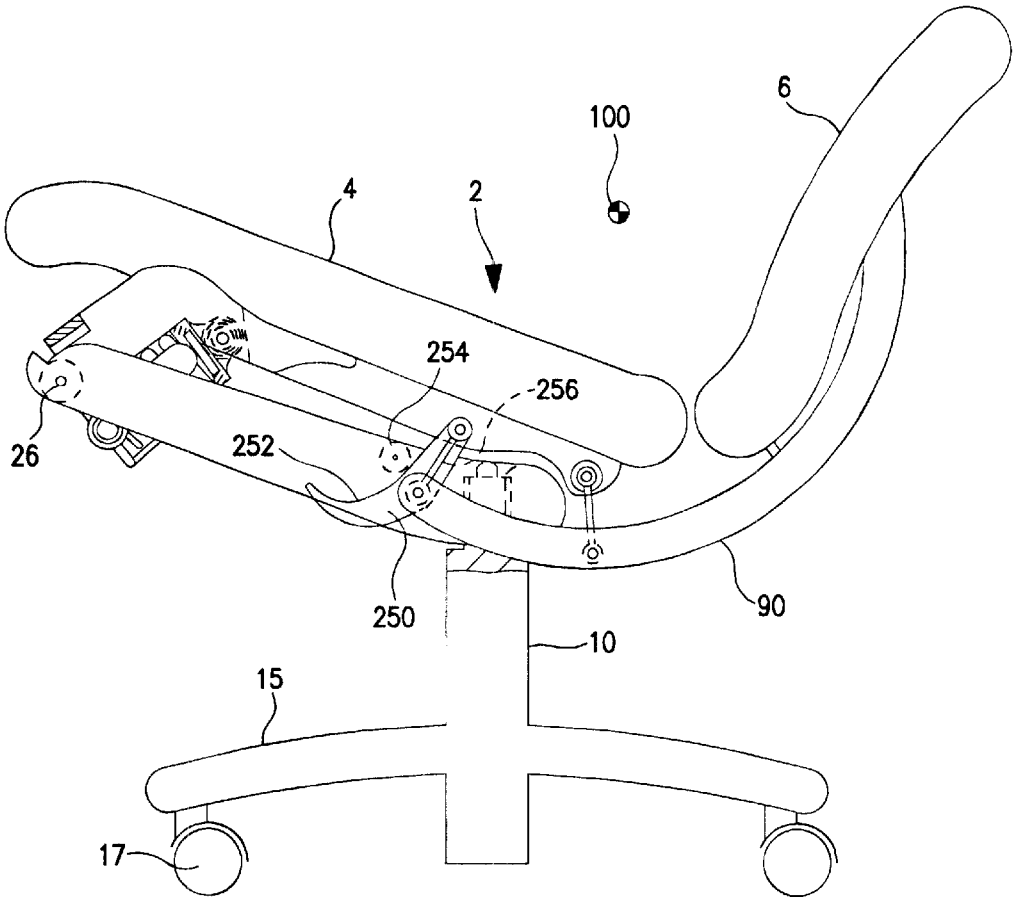

Referring to FIGS. 15 and 16, shown therein is another embodiment of the present invention with the back seat 6 in the upright position and the inclined position, respectively. This embodiment of FIGS. 15 and 16 is an improvement of the embodiment as shown in FIG. 11. In all other ways, the construction and operation of this embodiment is substantially the same as in FIG. 11.

In particular, referring to FIGS. 15 and 16, the bottom end of the pair of intermediate curved links 90 which are coupled to the back 6 at one end are further rotatably coupled to a curved cam 250 by a pair of links 256 and a shaft 258. The upper end of the curved cam 250 is fixedly coupled to the shaft 258 which is in turn rotatably coupled to the underside of the seat 4. The curved cam 250 is provided with a curved front surface 252 which rides against a roller 254 which is itself rotatably provided on support 16.

In operation, as the seat back 6 is simultaneously reclined with the seat 4 as is shown from FIGS. 15–16, the curved surface 252 of the cam 250 rides against the roller to 254. The shape of the curve of the front surface 252 together with the roller 254 provides timing of the back portion 6 to the seat 4 reclined motion. The curvature or shape of the surface 252 can be provided in any particular reclining ratio and by altering the curve or profile of the surface 252, relative motion between the seat 4 and the back portion is infinity variable. In other words, the reclining feel of the chair can be adjusted to be either linear, regressive or progressive to the full-reclined position. Typically, the shape 252 together with the roller 254 will be adjusted so that the entire seat can be reclined approximately 14 degrees, the entire back portion can be reclined approximately an additional 14 degrees and the total amount the back rest can be reclined is substantially 28 degrees.

As a result of the construction of the reclining chair 2 described in the embodiments above of the present invention, not only can a comfortable chair be provided but also one which is comfortable for a wide range of individuals of different weights. Still further, the mechanism can be quickly, smoothly and easily adjusted.

It should be apparent that the present invention would work equally as well if the mechanism was inverted or placed horizontally with additional links. It should also be apparent to those skilled in the art that numerous and other arrangements could be readily devised without departing from the spirit and scope of the present invention.

We claim:

1. A reclining chair comprising:

a support base;

a char comprising at least a seat portion;

a means for coupling a forward portion of said seat portion to said support base such that said seat portion moves substantially about a pivoting axis located adjacent said forward portion;

at least one coil spring provided adjacent said forward portion of said scat portion and between said seat portion and said support base;

a means for coupling ends of said coil spring pivotally to said seat portion arid said support base;

a means for pivoting one end of said coil spring about another end of said coil spring; and an offset crank means for driving said means for pivoting one end of said coil spring about another end thereof;

wherein said means for pivoting said one end of said coil spring about another end thereof comprises a boomerang shaped bell crank rotatably coupled to said support base at a center thereof with a long arm thereof being driven by said offset crank means and a short arm thereof coupled to said one end of said coil spring for pivoting said one end;

whereby by pivoting said one end of said coil spring about another end of said coil spring an effective force per unit distance of said coil spring is varied and reclining chair is made equally comfortable to sit and recline in throughout the entire range of heavy to lightweight persons.

2. The reclining chair according to claim 1 wherein said means for pivoting one end of said coil spring about said another end of said coil spring simultaneously varies a preload and said force per unit distance of said coil spring.

3. A reclining chair comprising:

a support base;

a chair comprising at least a seat portion;

a means for coupling a forward portion of said seat portion to said support base such that said seat portion moves substantially about a pivoting axis located adjacent said forward portion;

at least one coil spring provided adjacent said forward portion of said seat portion and between said seat portion and said support base;

a means for coupling ends of said coil spring pivotally to said seat portion and said support base, said means for coupling ends of said coil spring pivotally to said seat portion and support base comprise:

a first spring cup engaging one end of said coil spring, said first spring cup further comprising at least one arm extending longitudinally from said first spring cup along said coil spring with an extending end pivotally coupled to said support base; and a second spring cup engaging said another end of said coil spring, said second spring cup pivotally coupled to said seat portion;

a means for pivoting one end of said coil spring about another end of said coil spring;

an offset crank means for driving said means for pivoting one end of said coil spring about another end thereof; and wherein said means for pivoting one end of said coil spring about said another end thereof comprises a boomerang shaped bell crank rotatably coupled to said support base at a center thereof with a long arm thereof being driven by said offset crank means and a short arm thereof coupled to said another end of said coil spring for pivoting said one end;

whereby by pivoting said one end of said coil spring about another end of said coil spring an effective force per unit distance of said coil spring is varied and the reclining chair is made equally comfortable to sit and recline in throughout the entire range of heavy to lightweight persons.

4. The reclining chair according to claim 3 wherein said means for pivoting said one end of said coil spring about said another end of said coil spring comprises a means for moving said first spring cup.

5. The reclining chair according to claim 1 wherein said another end of said coil spring is pivotally fixed to said seat portion.

* * * * *